United States Patent [19]

Franks

[11] 4,430,236

[45] Feb. 7, 1984

[54] LIQUID DETERGENT COMPOSITION CONTAINING BLEACH

[75] Inventor: T. Chandler Franks, Mauldin, S.C.

[73] Assignee: Texize, Division of MortonThiokol, Greenville, S.C.

[21] Appl. No.: 275,791

[22] Filed: Jun. 22, 1981

[51] Int. Cl.[3] ..... C11D 3/395; C11D 7/54; D06L 3/00

[52] U.S. Cl. ..... 252/95; 252/8.75; 252/8.8; 252/99; 252/104; 252/186.29; 252/400 A; 252/407; 252/186.41

[58] Field of Search ..... 252/8.75, 8.8, 95, 99, 252/104, 186, 400 A, 407, 186.41, 186.29

[56] References Cited

U.S. PATENT DOCUMENTS

| | | | |
|---|---|---|---|
| 2,886,532 | 5/1959 | Richmond et al. | 252/186.29 X |
| 3,130,164 | 4/1964 | Best | 252/99 |
| 3,265,624 | 8/1966 | Iramorato | 252/99 |
| 3,537,993 | 11/1970 | Coward et al. | 252/8.75 |
| 3,573,211 | 3/1971 | Zweidler et al. | 252/95 |
| 3,609,075 | 9/1971 | Barbera | 252/8.6 |
| 3,625,905 | 12/1971 | Weast | 252/8.7 X |
| 3,630,894 | 12/1971 | Lazaridis et al. | 252/8.7 |
| 3,640,874 | 2/1972 | Gray | 252/95 |
| 3,640,877 | 2/1972 | Gobert | 252/99 |
| 3,649,569 | 3/1972 | McCarty | 252/8.75 X |
| 3,684,723 | 8/1972 | Best et al. | 252/99 X |
| 3,686,126 | 8/1972 | Sweets | 252/99 |
| 3,686,127 | 8/1972 | Boldingh et al. | 252/99 |
| 3,741,903 | 6/1973 | Evans | 252/95 |
| 3,759,846 | 9/1973 | Robb et al. | 252/8.6 X |
| 3,766,062 | 10/1973 | Wixon | 252/8.7 |
| 3,789,002 | 1/1974 | Weber et al. | 252/186.41 |
| 3,852,210 | 12/1974 | Krezanoski | 252/95 |
| 3,893,930 | 7/1975 | Sundhy et al. | 252/8.8 |
| 3,928,223 | 12/1975 | Murray | 252/95 |
| 3,932,295 | 1/1976 | Fujino | 252/102 |
| 3,945,937 | 3/1976 | Villaume | 252/95 X |
| 3,970,575 | 7/1976 | Barrett | 252/95 |
| 3,979,312 | 9/1976 | Nakagawa et al. | 252/99 |
| 3,993,573 | 11/1976 | Glass | 252/8.8 X |
| 3,996,151 | 12/1976 | Kizner | 252/99 X |
| 4,021,361 | 5/1977 | Lee | 252/95 X |
| 4,051,058 | 9/1977 | Bowing et al. | 252/186 |
| 4,079,015 | 3/1978 | Paucot et al. | 252/95 |
| 4,130,501 | 12/1978 | Lutz et al. | 252/95 X |
| 4,140,641 | 2/1979 | Ramachandran | 252/8.75 |
| 4,166,794 | 9/1979 | Grey | 252/8.8 |
| 4,199,466 | 4/1980 | Benson | 252/95 |
| 4,201,687 | 5/1980 | Crutchfield et al. | 252/99 X |
| 4,298,492 | 11/1981 | Brom | 252/97 |

FOREIGN PATENT DOCUMENTS

| | | | |
|---|---|---|---|
| 2743548 | 3/1979 | Fed. Rep. of Germany | 252/186.29 |
| 51-64082 | 6/1976 | Japan | 252/186.29 |
| 768506 | 2/1957 | United Kingdom | 252/186.41 |
| 1329416 | 9/1973 | United Kingdom . | |
| 1342240 | 1/1974 | United Kingdom . | |

*Primary Examiner*—Michael R. Lusignan
*Attorney, Agent, or Firm*—Bailey & Hardaway

[57] ABSTRACT

A single phase aqueous liquid laundry product containing a hydrogen peroxide bleach has a detergency effective amount of a nonionic surfactant or a mixture of a nonionic surfactant and an anionic surfactant and a brightening agent. In an embodiment the liquid product additionally contains a cationic fabric softener which provides for effective softening of fabrics as well as reduction of static cling. The product is stable for long periods of time and is effective for pretreatment stain removal.

25 Claims, No Drawings

LIQUID DETERGENT COMPOSITION CONTAINING BLEACH

BACKGROUND OF THE INVENTION

This invention relates generally to the art of liquid detergents, and, more particularly, to the art of a liquid laundry product containing both detergent and bleach or product containing detergent, bleach and fabric softener with a long shelf life.

Concentrated liquid detergent compositions have long been on the market. To date, however, no totally satisfactory laundry product containing both a concentrated detergent and a bleach has been available. It has been necessary to add liquid laundry products to the wash solution simultaneously with a measured amount of bleach so that it has been necessary to separately measure two products for the wash and withhold the bleach, if a hypochlorite bleach, until five minutes into the wash cycle. The primary difficulty which causes this duplicity of effort in the prior art has been the inability to produce a stable liquid laundry product containing both detergent and bleach. The term stable as used herein refers to the ability of a product to retain its essential characteristics while traveling through the marketplace moving from producer to consumer. Such products must be sufficiently stable to withstand the rigors of shipping, shelf storage and home storage. Since laundry products utilized heretofore have not possessed the required stability, it has been necessary to separately measure detergent and bleach at the time of use.

An attempt to overcome the above discussed stability problems has led to the use of powdered laundry products containing both detergent and bleach. By utilizing a powdered product it is possible to physically isolate the detergent component from the bleach component during storage. The components encounter one another only upon being dissolved within the wash water. While the use of a powdered product overcomes the stability problems, it does not result in the desirable attributes associated with a liquid product, such as the benefit obtained by pouring the liquid product directly onto a stained area of the fabric before washing, as well as ease of dissolving in cold water.

A phosphate based laundry product containing bleach is described in U.S. Pat. No. 3,130,164. The product is stated to be a stable suspension emulsion or a coacervate with little tendency for the components to separate out upon standing. This product, however, does contain a phosphate which from an environmental standpoint is undesirable.

SUMMARY OF THE INVENTION

It is thus an object of this invention to provide a liquid laundry product containing a detergent and a peroxide bleach which is stable during long periods of storage.

It is a further object of this invention to provide a liquid laundry product containing a detergent, a bleach, and a fabric softener without phosphates.

It is a yet further object of this invention to provide a liquid laundry product of single phase containing detergent and bleach, and possessing the ability to remove stains upon pretreatment which would not otherwise be effectively removed in the wash cycle.

It is a yet further, and more particular object of this invention to provide a process of cleansing all washable textile fabrics utilizing a liquid laundry product containing detergent and bleach.

These as well as other objects are accomplished by a liquid laundry product comprising a single phase aqueous solution of a detergency effective amount of a nonionic surfactant or a mixture of a nonionic surfactant and an anionic surfactant with hydrogen peroxide bleach and a brightening agent. In another embodiment, the product additionally contains within the solution a cationic fabric softener which provides for effective softening of fabrics and reduction of static cling. The products are utilized in a process of cleansing textile fabrics.

DETAILED DESCRIPTION

In accordance with this invention, it has been found that a single phase liquid laundry product may be produced having either a nonionic surfactant or a mixture of a nonionic surfactant and an anionic surfactant along with a hydrogen peroxide bleach. It has additionally been found that this single phase liquid product may additionally contain a cationic surfactant for use as a fabric softener and anti-static agent. The product of this invention has unexpectedly been found to possess sufficient stability to maintain its efficacy through the marketing chain. The liquid detergent in accordance with this invention may additionally contain brightening agents, solvents for viscosity reduction and complexing agent while retaining its single phase status and stability.

The liquid laundry product in accordance with this invention is a concentrated product adapted for use within a conventional washing machine. Generally, the product is adapted for use with 12 to 20 gallons of water utilizing $\frac{1}{4}$ cup (2 fl. oz.) to $\frac{1}{2}$ cup (4 fl. oz.) of liquid product depending on the water hardness and the washload. The liquid product in accordance with this invention is capable of laundering soiled textiles and also capable of removing stains from fabrics when contacted prior to introduction into the wash water as well as when contacted in the wash water. The product in accordance with this invention is useful as a bleach under prelaundering conditions for stain removal and as a detergent and a bleach in cold, medium and hot water laundering conditions.

In accordance with this invention, cold water laundering is generally referred to for washing temperatures of 80° F. or colder. Warm water temperatures are generally within the range of 90° to 110° F. Hot water temperatures are generally 130° F. or above. For energy conservation purposes, most U.S. households do their laundry utilizing cold to warm water laundering conditions. European countries, on the other hand, presently operate utilizing hot water temperatures. The laundry product in accordance with this invention is useful at virtually all temperatures suitable for laundering, but is preferably utilized at a temperature of 90°–110° F.

The laundry product in accordance with this invention contains a detergency effective amount of either a nonionic surfactant or a mixture of a nonionic surfactant and an anionic surfactant. By use of the term "detergency effective amount" it is meant an amount greater than that required to produce threshold wetting. It means an amount effective to result in actual cleansing when added to wash water at a normal dilution of $\frac{1}{4}$ to $\frac{1}{2}$ cup per 12 to 20 gallons of water. Generally, a detergency effective amount varies with the nature of the surfactant, the number of surfactants present and the concentration of each. When using $\frac{1}{4}$ to $\frac{1}{2}$ cup of laundry product per 12 to 20 gallons of wash water, a total nonionic and anionic surfactant content based on a percent by weight of the concentrated liquid of about 15 is a lower limit for effective cleansing. A lesser surfactant content requires a larger addition to the wash liquid.

In accordance with this invention, the surfactant within the single phase liquid may be either a nonionic surfactant or a mixture of a nonionic surfactant and an anionic surfactant. It has been found necessary to maintain the presence of a nonionic surfactant because of the excellent detergency (cleaning) properties of the nonionic surfactant, especially for oily and/or grease soils. It has also been found that the nonionic surfactant increased the stability of other constituents in the liquid product.

An unexpected benefit of the presence of an anionic surfactant within the liquid detergent composition of this invention is an increase in brightness when the anionic surfactant is present along with the optical brighteners discussed below. It has been found that if a composition contains optical brighteners without the presence of an anionic surfactant, a certain level of brightness is achieved. If, however, the same amount of optical brightener is present in the detergent composition of this invention, as well as an effective amount of anionic surfactant, the degree of brightness achieved is significantly increased. It has been found that this combination produces a synergistic result.

The nonionic surfactant for use in the product of this invention is preferably an ethoxylate of an alcohol having from 7 to 11 ethylene oxide units per molecule. The nonionic surfactants may be any of the well known surfactants of the above class. The alcohol may be a primary alcohol having from 11 to 15 carbon units per molecule. Additionally, the alcohol may be a secondary alcohol having from 11 to 15 carbon units per molecule. Specific nonionic surfactants useful with this invention include linear primary alcohol ethoxylates having from 12 to 15 carbon atoms with an average of 9 ethylene oxide units per molecule; linear secondary alcohol ethoxylate having from 11 to 15 carbon atoms with an average of 9 ethylene oxide units per molecule; linear primary-secondary alcohol ethoxylates having from 12 to 15 carbon atoms with an average of 9 ethylene oxide units per molecule; nonyl phenoxy polyethoxyethanol with an average of 10.3 ethylene oxide units per molecule; octyl phenoxy polyethoxyethanol with an average 9 ethylene oxide units per molecule. The nonionic surfactants listed above are not exclusive of other nonionic surfactants which may be utilized within the scope of this invention.

The preferred anionic surfactant in the liquid laundry product of this invention is sodium dodecylbenzenesulfonate. However, a sodium alkyl benzene sulfonate having from 10 to 16 carbon atoms may be utilized. Additionally, useful anionic surfactants include sodium, potassium, triethanolamine, and diethanolamine salts of linear secondary alkyl sulfonates or linear alkyl benzene sulfonates. The preferred chain length within the alkyl radical of the above discussed salts of secondary alkyl sulfonates is an average chain length of 15.5. These anionic surfactants are illustrative of surfactants useful within the scope of this invention and are not an exclusive listing of all surfactants which may be useful within the scope of this invention.

It has been found desirable and preferable to include fluorescent brightening agents within the single phase liquid laundry product of this invention. Such fluorescent brightening agents may be any of those conventionally utilized within the prior art which includes distyrylbiphenyl derivative, e.g., $C_{28}H_{22}O_6S_2.2Na$; and naphthotriazostilbene sulfonate, $C_{24}H_{17}N_3NaO_3S$. Other brightening agents known to the art which are compatible with and capable of forming a single phase liquid laundry product may be utilized within the scope of this invention.

The laundry product in accordance with this invention is preferably maintained at a viscosity which makes it useful for pouring at normal room temperatures. For this reason it is preferred to include within the composition a viscosity reducing solvent in order to maintain the viscosity within a range of from 50 to 400 centiposes at a temperature of about 75° F. For this purpose, a solvent may be utilized such as an alcohol having 2 or 3 carbon atoms, sodium xylenesulfonate or sodium toluenesulfonate. As a preferred embodiment, either ethanol or isopropanol may be utilized alone or in combination with sodium xylenesulfonate or sodium toluenesulfonate to arrive at a desirable viscosity within the temperature range of anticipated use.

A surprising aspect of this invention is the stability of the single phase liquid upon storage for long periods of time. Heretofore it had been felt that the hydrogen peroxide would react with other constituents or trace metals thus causing a significant loss in the hydrogen peroxide content upon storage. Unexpectedly, however, applicant's laundry product has displayed only a 16.5 percent loss in hydrogen peroxide content after storage for 26 months at room temperature. Thus, applicant's laundry product does not require the addition to or presence of a stabilizing agent, and it must be assumed that the combination of ingredients contributes to this unexpected stability.

As a preferred feature for a commercial product, however, a chelating agent is utilized in order to assure a long storage life for the hydrogen peroxide bleach. A chelating agent in the form of ethylenediaminetetracetic acid (EDTA) is preferred. The preferred embodiment utilizes EDTA in the sodium form, sodium ethylenediaminetetraacetate, to maintain the stability of the hydrogen peroxide bleach. This stability is achieved by complexing ions such as divalent metals which otherwise might react with the hydrogen peroxide.

The hydrogen peroxide content of the product of this invention may be within the range of 1 to 20 percent by weight of a 50% by weight diluted aqueous solution. At the lower concentrations stain removal upon pretreatment is achieved without significant bleaching in warm wash water. As the hydrogen peroxide content is increased, however, bleaching noticeably occurs at preferred concentration of 12 percent (expressed as 50% hydrogen peroxide) by weight.

As an additional embodiment of the present invention, a cationic surfactant may be included within the single phase liquid laundry product of this invention for the purpose of adding fabric softening properties to the laundry product. Any of the conventionally utilized cationic surfactants which are compatible with the liquid laundry product of this invention may be utilized. Preferred cationic surfactants are selected from the group consisting of polyethyelene glycol (2) tallow ammomium chloride, polyethylene glycol (2) cocoa ammonium chloride, and 1-methyl-1-oleylamidoethyl-2-oleylimidazolinium methosulfate. The product in this embodiment thus has the ability to serve as a stain remover by pretreatment, a wash bleach depending on the amount of hydrogen peroxide, a detergent and/or fabric softener. This is a highly desirable product, in that, all components are added with only one measurement per wash load.

An optional constituent for use with the liquid product of this invention is a standard fragrance bearing oil. Such oils are conventional and well known to the art.

Having generally described the constituents which are utilized to produce the single phase liquid laundry product in accordance with this invention, the following table is set forth as a summary of the constituents and composition ranges.

TABLE

| Constituent | Parts by Weight Preferred Composition | Range |
|---|---|---|
| Sodium dodecylbenzenesulfonate(1) | 10.3 | 2–12 |
| Fluorescent brightening agents: | | |
| Distyrylbiphenyl derivative(2) | 0.10 | 0.01–1.00 |
| Naphthotriazostilbene sulfonate(3) | 0.05 | 0.01–1.00 |
| Sodium xylenesulfonate, 40%(4) | 16.4 | 1–20 |
| Linear primary $C_{14}$–$C_{15}$ alcohol ethoxylate(5) containing an average of seven ethylene oxide units per mole | 17.5 | 5–45 |
| Polyethylene Glycol (2) tallow ammonium chloride, 75%(6) | 7.0 | 2–15 |
| Hydrogen peroxide, 50% | 5.8 | 1–20 |
| Acid Blue 25 (C.I. 62055)(7) | 0.006 | 0.001–0.015 |
| EDTA (sodium), 40% | 0.2 | 0–1.0 |
| Essential oils fragrance | 0.15 | 0.01–0.60 |
| Water | Balance to 100 parts | |

(1)Chemical Formula: Linear $C_{12}H_{25}$—$C_6H_4$—$SO_3Na$
Alternate Anionic Surfactant: Sodium, potassium, diethanolamine, and triethanolamne salts of linear secondary alkyl sulfonates or alkyl benzene sulfonates
(2)Distyrylbiphenyl derivative: Chemical Formula: $C_{28}H_{22}O_6S_2.2Na$
(3)Naphthotriazostilbene sulfonate: Chemical Formula: $C_{24}H_{17}N_3NaO_3S$
(4)Ethanol or Isopropanol in the range of 1–20% may be used alone or in combination with sodium xylenesulfonate or sodium toluenesulfonate.
(5)Alternates:
A. PRIMARY ALCOHOL NONIONIC: Linear primary alcohol ethoxylate, $C_{12}$–$C_{15}$ primary alcohol, average of 9 ethylene oxide units per molecule.
B. SECONDARY ALCOHOL NONIONIC: Linear secondary alcohol ethoxylate, $C_{11}C_{15}$, average of 9 ethylene oxide units per molecule.
C. PRIMARY/SECONDARY BLEND NONIONIC: Linear primary-secondary alcohol ethoxylate, $C_{12}$–$C_{15}$, average of 9 ethylene oxide units per molecule.
D. NONYL PHENOL NONIONIC: Nonyl phenoxy polyethoxyethanol, average of 10.3 ethylene oxide units per molecule.
E. OCTYL PHENOL NONIONIC: Octyl phenoxy polyethoxyethanol, average of 9 ethylene oxide units per molecule.
(6)Polyethylene Glycol (2) tallow ammonium chloride; a cationic softener of the formula:

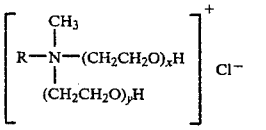

Where R represents the tallow or cocoa radical and $x + y$ has an average value of 2.
Or an alternate cationic softener, 1-methyl-1-oleylamidoethyl-2-oleylimidazolinium methosulfate (75%), of the formula:

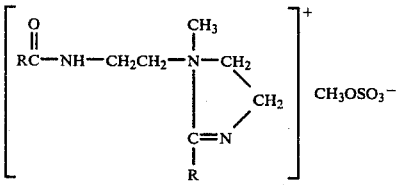

Where R represents the oleic radical.
(7)Alternate: Acid Blue 182 (sulfonated amino anthraquinone).

The composition in accordance with this invention is prepared by conventional mixing techniques. The composition is preferably prepared by maintaining the solution in a pH range of 3 to 8 with a preferred range being 4 to 5.5. No homogenization or preliminary treatment is required prior to releasing the product to the consumer. Having generally set forth the invention, the following example is given of the process of preparing the liquid detergent composition in accordance with this invention.

EXAMPLE 1

Preparation of Batch

The following components were added to warm (110° F.) water (maximum of 10 ppm hardness expressed as calcium carbonate) while stirring, in the order listed below:

10.3 Parts sodium dodecylbenzenesulfonate,
16.4 Parts sodium xylenesulfonate, 40% solution
17.5 Parts linear primary $C_{14}$–$C_{15}$ alcohol ethoxylate containing an average of seven ethylene oxide units per molecule
0.10 Parts distyrylbiphenyl derivative (brightening agent)
0.05 Parts naphthotriazostilbene sulfonate (brightening agent)
0.2 Parts EDTA (Sodium), 40%
7.0 Parts polyethylene glycol (2) tallow ammonium chloride, 75%
0.15 Parts essential oils fragrance
0.006 Parts Acid Blue 25 (C.I. 62055) Dye.

Stirring was continued until all components were dissolved.

The pH of the solution was adjusted to 4.0–5.5 using small amounts of sulfuric acid or sodium hydroxide solution, as needed.

The solution was cooled to 80° F. and (with stirring) 5.8 parts hydrogen peroxide (50%) added.

EXAMPLE 2

A laundry product prepared in the manner of Example 1 and having the composition specified therein was tested for hydrogen peroxide content over a period of six months.

The test for hydrogen peroxide content was carried out using Kingzett's Iodide Method for Determination of Hydrogen Peroxide, with the following results:

| | |
|---|---|
| Original % Hydrogen Peroxide (expressed as 50% Hydrogen Peroxide) | 5.8% |
| % Hydrogen Peroxide (expressed as 50% Hydrogen Peroxide) six months later stored at room temperature | 5.6% |
| Percent loss of Hydrogen Peroxide | 3.4% |

It is further contemplated that this invention includes the process of cleansing textile fabrics utilizing the single phase laundry product of this invention for so doing. The process simply comprises adding ¼ to ½ cup of the liquid laundry product of this invention to 12 to 20 gallons of wash water containing soiled textile fabrics. The wash process is carried out in the conventional manner utilizing cold, warm or hot wash water. The preferred wash temperature is within the warm water range for the practice of the process in accordance with this invention. The process of this invention additionally comprises contacting stains on fabrics with the product of this invention prior to immersing the fabric in the wash water. In accordance with this invention the total product required for use in the wash water is unaltered even if a pretreatment for stain removal is required.

It is thus seen that this invention provides a novel single phase laundry product containing a detergent and hydrogen peroxide bleach. Surprisingly, the liquid laundry product in accordance with this invention is stable over long periods of time, and may within another embodiment contain a fabric softener within the scope of this invention. It is further seen that the product of this invention is useful as a pretreatment stain remover. It is further seen that this invention comprises a process of cleansing textile fabric by the addition to the wash water of only a single liquid, thus eliminating the need for multiple measurements at the point of cleansing. As many variations will be apparent from a reading of the above detailed description, the spirit and scope of this invention is to be measured only by the following appended claims.

That which is claimed is:

1. A generally single phase substantially phosphate free liquid aqueous solution for use as a laundry detergent and bleach comprising:

a detergency effective amount of a member selected from the group consisting of a nonionic surfactant or a mixture of a nonionic surfactant and an anionic surfactant;

hydrogen peroxide bleach present in an amount equivalent to about 1 to about 20 percent by weight of a 50 percent by weight aqueous solution of hydrogen peroxide;

a fluorescent brightening agent present in an amount of from about 0.01 to about 2.0 percent by weight; and an aqueous medium;

and wherein said single phase liquid has a loss of less than four and one half percent (4.5%) of original hydrogen peroxide content in two (2) months at 77 degrees F.

2. The generally single phase liquid for use as a laundry detergent and bleach in accordance with claim 1 further comprising a viscosity reducing amount of a solvent selected from the group consisting of $C_2$ or $C_3$ alcohols, sodium xylenesulfonate or sodium toluenesulfonate.

3. The generally single phase liquid for use as a laundry detergent and bleach in accordance with claim 1 wherein said brightening agent is a mixture of distyrylbiphenyl derivative and naphthotriazostilbene sulfonate.

4. The generally single phase liquid for use as a laundry detergent and bleach in accordance with claim 1 wherein said nonionic surfactant is an ethoxylate of an alcohol having from 7 to 11 ethylene oxide units per molecule.

5. The generally single phase liquid for use as a laundry detergent and bleach in accordance with claim 1, wherein said anionic surfactant is a linear secondary alkyl sulfonate salt.

6. The generally single phase liquid for use as a laundry detergent and bleach in accordance with claim 1 wherein said anionic surfactant is a sodium $C_{10}$ to $C_{16}$ alkylbenzenesulfonate.

7. The generally single phase liquid for use as a laundry detergent and bleach in accordance with claim 1 further comprising as a complexing agent sodium ethylenediaminetetraacetate.

8. The generally single phase liquid for use as a laundry detergent and bleach in accordance with claim 1 further comprising a blue dye.

9. The generally single phase liquid for use as a laundry detergent and bleach in accordance with claim 1 further including a cationic surfactant for use as a fabric softener and anti-static agent.

10. The generally single phase liquid for use as a laundry detergent bleach and fabric softener in accordance with claim 9 wherein said cationic surfactant comprises a member selected from the group consisting of polyethylene glycol (2) tallow ammonium chloride, polyethylene glycol (2) cocoa ammonium chloride, and 1-methyl-1-oleylamidoethyl-2-oleylimidazolinium methosulfate.

11. The generally single phase liquid for use as a laundry detergent, bleach and fabric softener in accordance with claim 10 further comprising a blue dye.

12. The generally single phase liquid for use as a laundry detergent, bleach and fabric softener in accordance with claim 10 further comprising a viscosity reducing amount of a solvent selected from the group consisting of $C_2$ or $C_3$ alcohols, sodium xylene-sulfonate or sodium toluenesulfonate.

13. The generally single phase liquid for use as a laundry detergent, bleach and fabric softener in accordance with claim 10 wherein said brightening agent is a mixture of distyrylbiphenyl derivative and naphthotriazostilbene sulfonate.

14. The generally singly phase liquid for use as a laundry detergent, bleach and fabric softener in accordance with claim 10 wherein said nonionic surfactant is an ethoxylate of an alcohol having from 7 to 11 ethylene oxide units per molecule.

15. The generally single phase liquid for use as a laundry detergent, bleach and fabric softener in accordance with claim 10 wherein said anionic surfactant is a linear secondary alkyl sulfonate salt or alkyl benzene sulfonate salt.

16. The generally single phase liquid for use as a laundry detergent, bleach and fabric softener in accordance with claim 15 wherein said anionic surfactant is a sodium $C_{10}$ to $C_{16}$ alkylbenzenesulfonate.

17. The generally single phase liquid for use as a laundry detergent, bleach and fabric softener in accordance with claim 10 further comprising as a complexing agent sodium ethylenediaminetetraacetate.

18. A process for laundering fabrics comprising:

contacting said fabrics with the liquid of claim 1 in an aqueous medium for a period of time sufficient to clean said fabric.

19. The process according to claim 18 wherein ¼ to ½ cup of said liquid is utilized with 12 to 20 gallons of water to launder said fabric.

20. The process according to claim 18 wherein said step of contacting is carried out at a temperature of less than 140° F.

21. The process of claim 18 including prior to said step of contacting pretreating stains by contacting said stains with said liquid.

22. The generally single phase liquid for use as a laundry detergent and bleach in accordance with claim 1, having less than 16.5% loss in hydrogen peroxide content after 26 months at room temperature.

23. The generally single phase liquid for use as a laundry detergent and bleach in accordance with claim 1, having less than 3.4% loss in hydrogen peroxide content after 6 months storage at room temperature.

24. The generally single phase substantially phosphate free liquid in accordance with claim 1 having 12% of said 50% aqueous hydrogen peroxide solution.

25. The generally single phase liquid in accordance with claim 1 having a brightening agent content of 0.01 to 1% by weight.

* * * * *